US010099269B1

(12) United States Patent
Lin et al.

(10) Patent No.: US 10,099,269 B1
(45) Date of Patent: Oct. 16, 2018

(54) DRAWING DEVICE

(71) Applicants: Yu-Hung Lin, Taichung (TW); Cheng-Tse Chang, Changhua County (TW)

(72) Inventors: Yu-Hung Lin, Taichung (TW); Cheng-Tse Chang, Changhua County (TW)

( * ) Notice: Subject to any disclaimer, the term of this patent is extended or adjusted under 35 U.S.C. 154(b) by 0 days.

(21) Appl. No.: 15/789,578

(22) Filed: Oct. 20, 2017

(51) Int. Cl.

| | |
|---|---|
| ***B21J 9/18*** | (2006.01) |
| ***B21D 1/06*** | (2006.01) |
| ***B25B 11/00*** | (2006.01) |
| ***B21D 1/12*** | (2006.01) |
| *B21D 37/00* | (2006.01) |

(52) U.S. Cl.
CPC ..... *B21D 1/06* (2013.01); *B21D 1/12* (2013.01); *B25B 11/007* (2013.01); *B21D 37/00* (2013.01)

(58) Field of Classification Search
CPC .. B21D 1/06; B21D 37/00; B21D 1/12; B25B 11/007
USPC ..... 72/445
See application file for complete search history.

(56) References Cited

U.S. PATENT DOCUMENTS 3,712,106 A * 1/1973 Holsapple ..... B21D 1/12 72/309
3,728,891 A * 4/1973 Hall, Jr. ..... B21D 1/06 72/465.1
3,779,057 A * 12/1973 Sonnenberg ..... B21D 1/06 72/56
4,026,139 A * 5/1977 Glaser ..... B21D 1/06 72/390.4
4,050,271 A * 9/1977 Jones ..... B21D 1/06 72/37
4,116,035 A * 9/1978 Malarsky ..... B21D 1/06 72/389.6
4,930,335 A * 6/1990 Ishihara ..... B21D 1/06 72/451
5,727,418 A * 3/1998 Strozier ..... B21D 1/06 72/457
7,181,951 B1 * 2/2007 Schmidt ..... B21D 1/06 72/309
7,430,891 B1 * 10/2008 Wang ..... B21D 1/06 72/453.01
8,516,875 B1 * 8/2013 Chan ..... B21D 1/06 29/267
8,651,458 B2 * 2/2014 Liao ..... B25B 11/007 254/133 R (Continued)

*Primary Examiner* — David B Jones
(74) *Attorney, Agent, or Firm* — Muncy, Geissler, Olds & Lowe, P.C.

(57) ABSTRACT

A drawing device includes a main body, a seat body, a central axle, two supporting members and a driving structure. The seat body is rotatably connected to the main body and has two legs which have a preset distance therebetween, the central axle vertically penetrates the main body and the seat body and movable along a vertical direction, the main body and the seat body are rotatable about the central axle relative to each other, a bottom portion of the central axle penetrates the seat body for a sucking disc to be arranged thereon, the two supporting members are respectively swingably pivoted to the two legs of the seat body, and the central axle is located between the two supporting members, and the driving structure is attached to the main body and connected to the central axle to optionally move the central axle upward.

9 Claims, 5 Drawing Sheets

(56) References Cited

U.S. PATENT DOCUMENTS 9,441,622 B2 * 9/2016 Liao ..... F04B 37/14
9,669,442 B1 * 6/2017 Alvarez ..... B21D 1/06

* cited by examiner

DRAWING DEVICE

BACKGROUND OF THE INVENTION

Field of the Invention

The present invention relates to a drawing device, and more particularly to a drawing device used to repair a dented metal plate.

Description of the Prior Art

Conventionally, when a metal plate is dented due to external force, one may use a drawing device which has a sucking disc to pull up the dented part so as to repair and flatten the metal plate. The drawing device usually includes a main body, a central axle, a supporting assembly, a sucking disc and a pressing rod, the central axle is disposed through the main body, a bottom end of the central axle has the sucking disc, the supporting assembly is disposed on a lower end of the main body to prop on a surface of the metal plate, and the pressing rod is disposed on the main body to move the central axle upward and downward so as to suck up the dented part.

However, the pressing rod and the supporting assembly are arranged on fixed positions of the main body, so it is hard to operate the pressing rod and the supporting assembly. For example, when the supporting assembly can stably prop on the metal plate, a direction or a position of the pressing rob may make it hard for a user to press or apply force or impossible to operate in a narrow space. Vise versa, when the position of the pressing rod allows the user to apply force, there may be no place for the supporting assembly to prop on.

The present invention has arisen to mitigate and/or obviate the afore-described disadvantages.

SUMMARY OF THE INVENTION

The major object of the present invention is to provide a drawing device, which is convenient for a user to operate from his/her standpoint to repair a dented metal plate.

To achieve the above and other objects, a drawing device is provided, including a main body, a seat body, a central axle, two supporting members and a driving structure.

The seat body is disposed below the main body and rotatably connected to the main body, and a bottom portion of the seat body has two legs which have a preset distance therebetween; the central axle vertically penetrates the main body and the seat body and movable along a vertical direction, the main body and the seat body are rotatable about the central axle relative to each other, and a bottom portion of the central axle penetrates the seat body for a sucking disc to be arranged thereon; the two supporting members are respectively swingably pivoted to the two legs of the seat body, and the central axle is located between the two supporting members; and the driving structure is attached to the main body and connected to the central axle to optionally move the central axle upward.

Thereby, a user can rotate the main body to rotate the driving structure to an appropriate angle or position so that the user can repair a dented part of a metal plate conveniently even in a narrow space where is difficult for operation.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
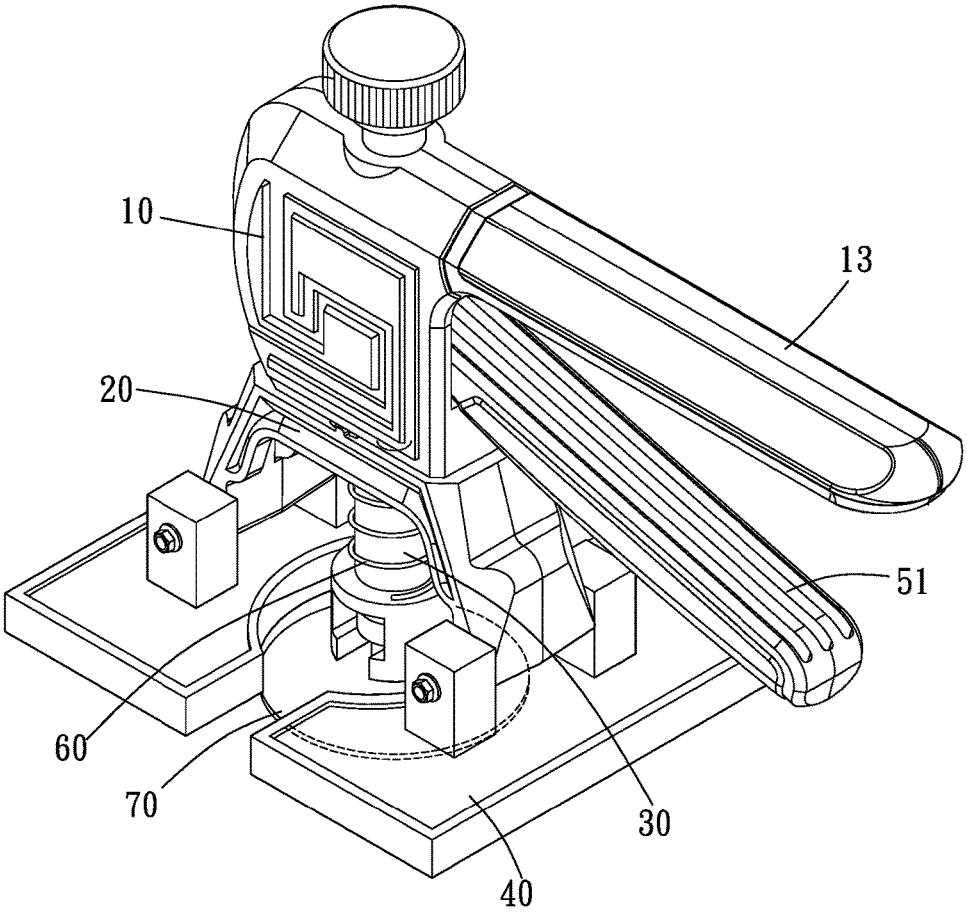
FIG. 1 is a stereogram of the present invention.
Figures 2, 2A:
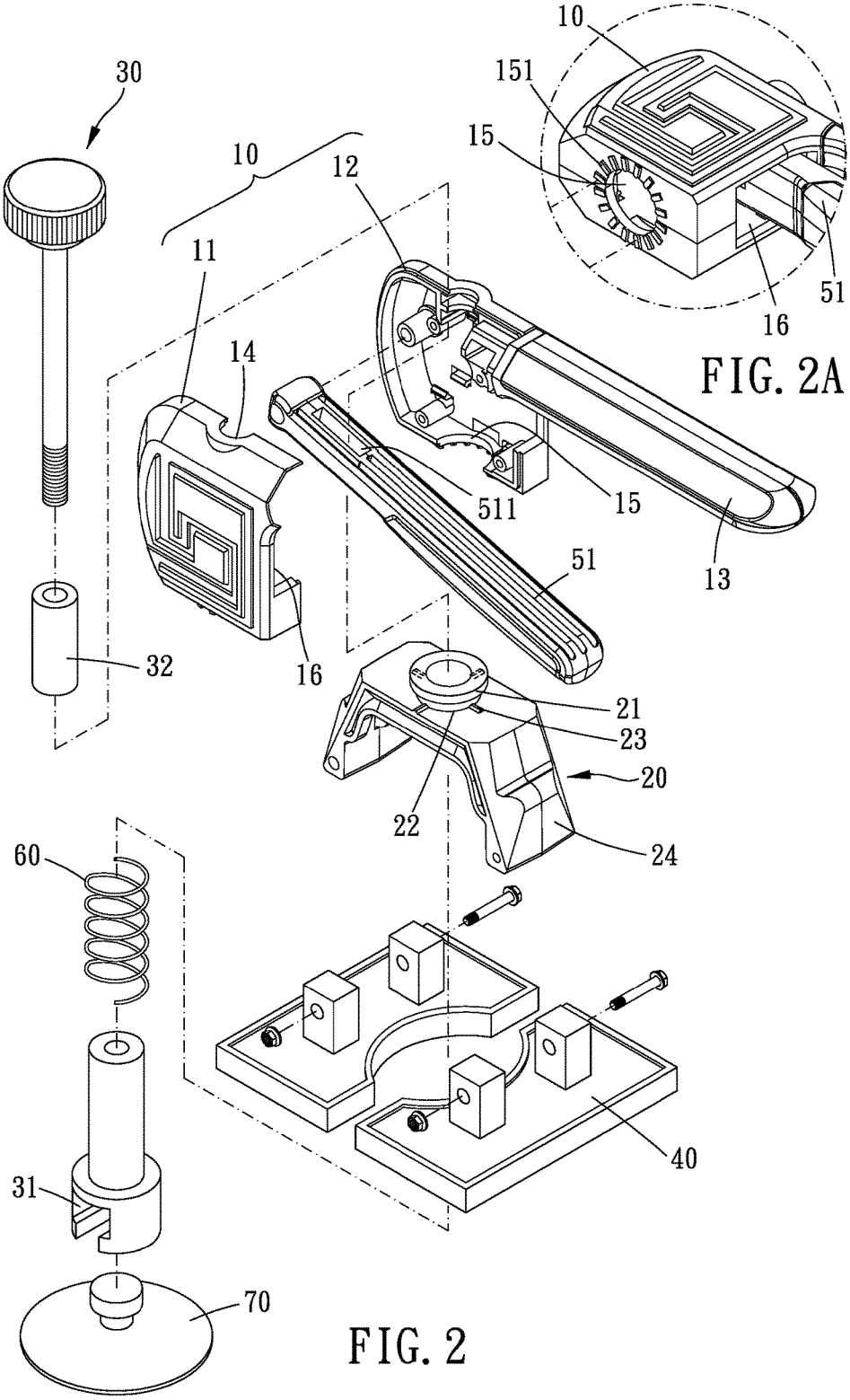
FIG. 2 is a breakdown stereogram of the present invention.
FIG. 2A is a stereogram of a main body of the present invention from another perspective.
Figure 3:
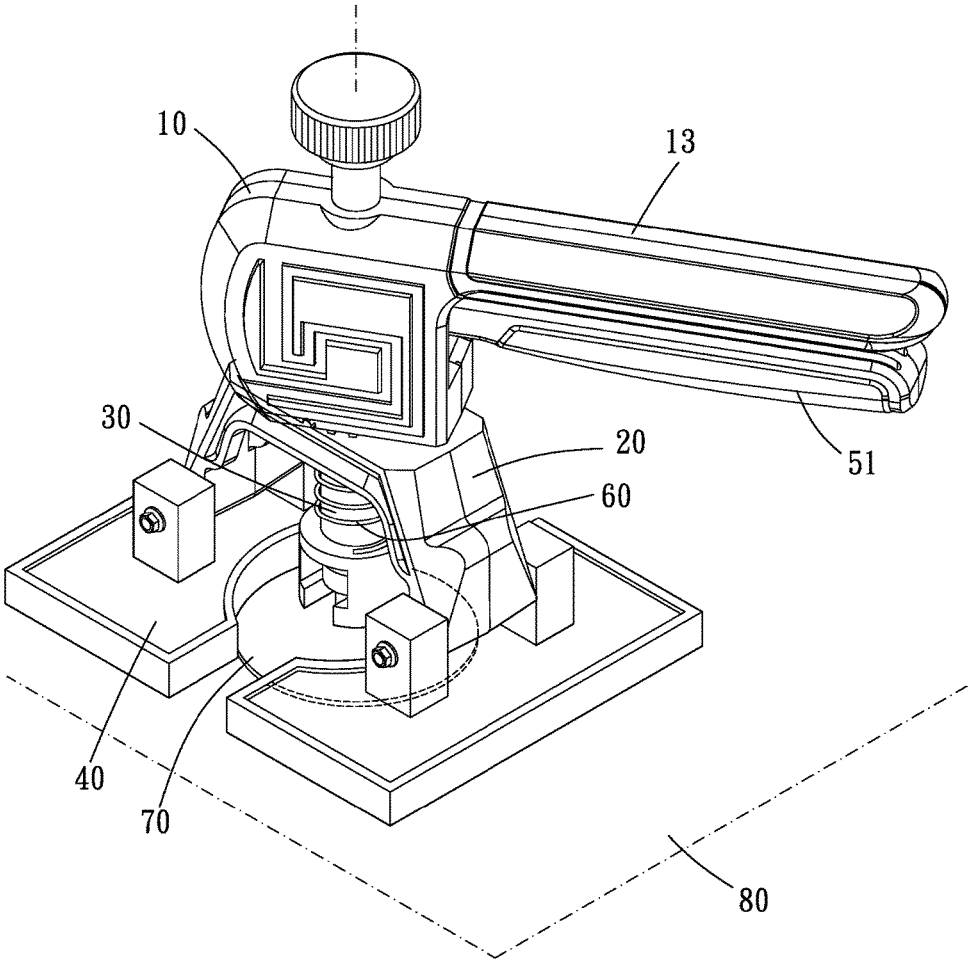
FIG. 3 is a drawing showing the present invention in use.
Figure 4:
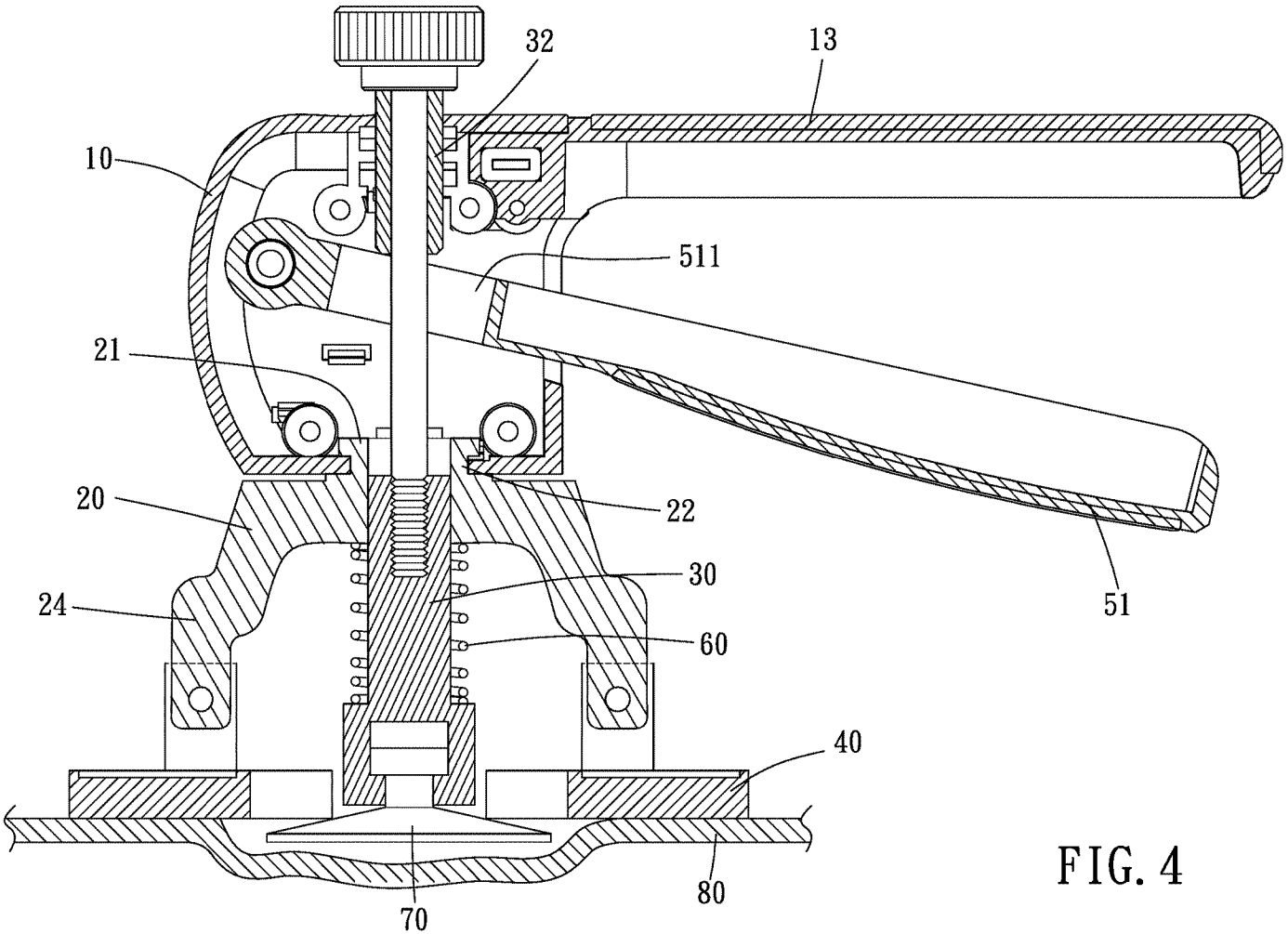
FIG. 4 is a cross-sectional view of the present invention.
Figure 5:
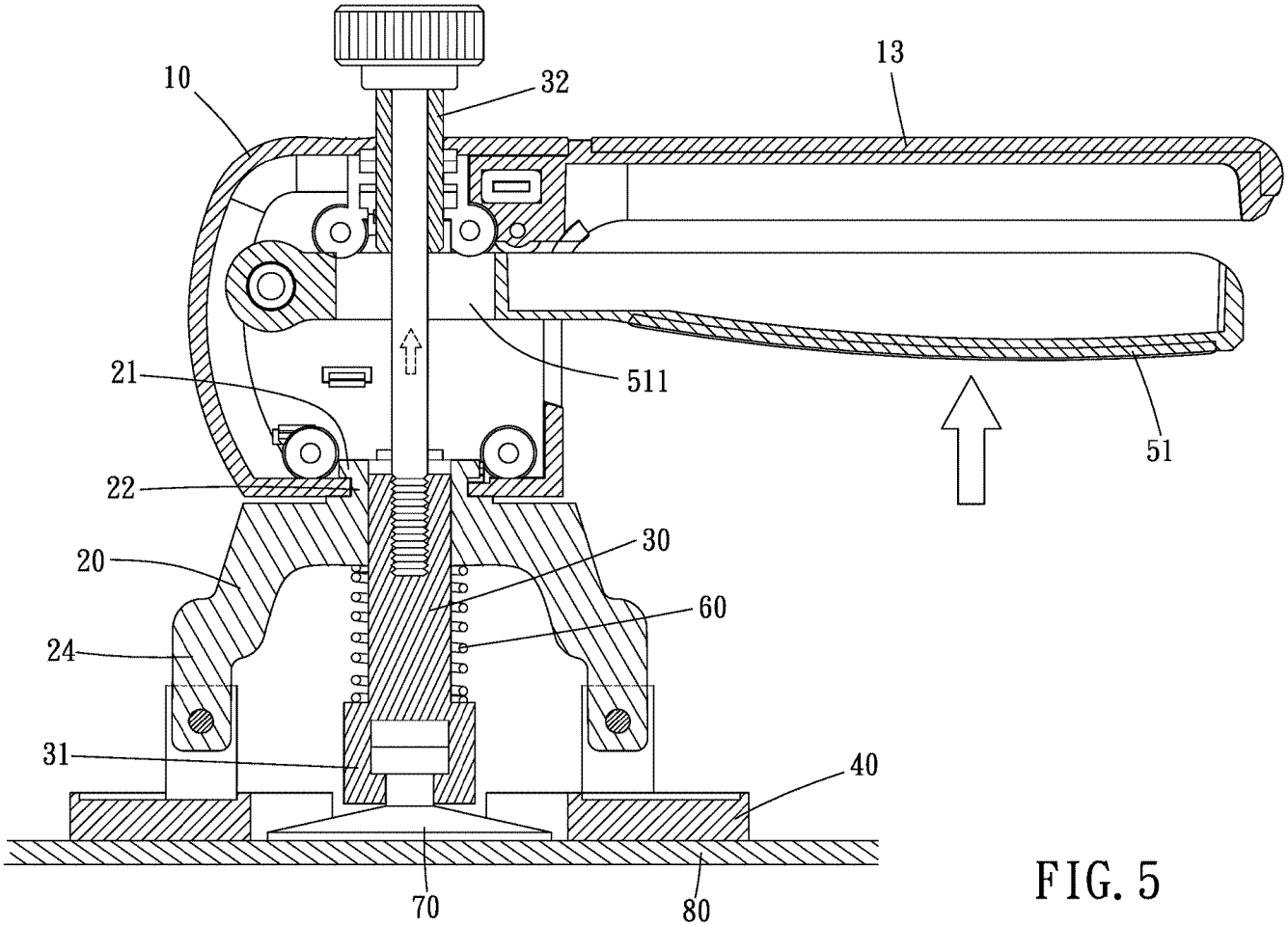
FIG. 5 is a cross-sectional view showing the present invention in use.

Please refer to FIGS. 1 to 5 and 2A, a drawing device is provided, including a main body 10, a seat body 20, a central axle 30, two supporting members 40 and a driving structure.

The seat body 20 is disposed below the main body 10 and rotatably connected to the main body 10, and a bottom portion of the seat body 20 has two legs 24 which have a preset distance therebetween; the central axle 30 vertically penetrates the main body 10 and the seat body 20 and movable along a vertical direction, the main body 10 and the seat body 20 are rotatable about the central axle 30 relative to each other, and a bottom portion of the central axle 30 penetrates the seat body 20 for a sucking disc 70 to be arranged thereon; the two supporting members 40 are respectively swingably pivoted to the two legs 24 of the seat body 20, and the central axle 30 is located between the two supporting members 40; and the driving structure is attached to the main body 10 and connected to the central axle 30 to optionally move the central axle 30 upward.

Specifically, in this embodiment, the main body 10 includes two shells 11, 12, the two shells 11, 12 define a receiving space, the main body 10 has an upper hole 14, a lower hole 15 and a side opening 16, the upper hole 14, the lower hole 15 and the side opening 16 respectively communicate with the receiving space, the upper hole 14, the lower hole 15 and the side opening 16 are respectively defined by the two shells 11, 12, the central axle 30 penetrates the upper hole 14, the receiving space and the lower hole 15, and the main body 10 is connected to the seat body 20 via the lower hole 15; the main body 10 extends outward from above the side opening 16 to form an upper pressing rod 13, the driving structure includes a lower pressing rod 51, one of two ends of the lower pressing rod 51 is pivoted within the receiving space, the other of the two ends of the lower pressing rod 51 protrudes beyond the main body 10 from the side opening 16, the lower pressing rod 51 further forms a through hole 511, the through hole 511 extends vertically, the central axle 30 is disposed through the through hole 511, the central axle 30 has a radially-enlarged portion 32 above the through hole 511 of the lower pressing rod 51, and the lower pressing rod 51 can be pressed to swing toward the upper pressing rod 13 so as to push the radially-enlarged portion 32 to lift the central axle 30 upward. In addition, the bottom portion of the central axle 30 has a connecting portion 31 which has a greater outer diameter, the connecting portion 31 is for being connected to the sucking disc 70, and a spring 60 is further sleeved on the central axle 30 and bounces between the bottom portion of the seat body 20 and the connecting portion 31 to make the central axle 30 have a tendency to move downward.

Regarding a rotation structure of the main body 10 and the seat body 20, a top portion of the seat body 20 extends upward to form a neck portion 22, a top portion of the neck portion 22 has an annular edge 21 which protrudes outward, an outer diameter of the annular edge 21 is greater than an inner diameter of the lower hole 15 of the main body 10 and is received within the receiving space, and the neck portion 22 is rotatably disposed through the lower hole 15 of the main body 10. Preferably, the bottom portion of the main body 10 protrudes downward to form a plurality of first protrusions 151, the first protrusions 151 are arranged around the lower hole 15, the top portion of the seat body 20 protrudes upward to form a plurality of second protrusions 23, the second protrusions 23 are arranged around the neck portion 22, and the first protrusions 151 correspond to the second protrusions 23 so that the main body 10 and the seat body 20 are releasably positionable with each other. In this embodiment, a number of the first protrusions 151 is greater than a number of the second protrusions 23 to prevent overly interfering a rotation smoothness.

Regarding the two supporting members 40, each of the two supporting members 40 is plate-shaped and pivoted to a bottom end of the leg 24 of the seat body 20, the two supporting members 40 are respectively swingable about two pivotal axles parallel to each other, a side of each of the two supporting members 40 facing the other of the two supporting members 40 has a recessed curved portion, a space defined by the two recessed curved portions allow the central axle 30 and the sucking disc 70 to pass therethrough, and each of the two supporting members 40 may be made of materials which will not damage a surface of the metal plate, for example, rubber or plastic.

During an assembling process, the lower pressing rod 51 is firstly pivoted to one of the two shells 12, then the annular edge 21 of the seat body 20 is arranged within the shell 12, the central axle 30 penetrates the through hole 511 of the lower pressing rod 51 and further penetrates the seat body 20, and finally, the other of the two shells 11 is fixed to the shell 12 so that the annular edge 22 of the seat body 20 is closed in the main body 10. Therefore, the main body 10 and the seat body 20 can be assembled to each other easily to make a rotatable structure which will not disengage easily.

When using the drawing device, the user sucks the sucking disc 70 on a dented part of a metal plate 80, props the two supporting members 40 by two sides of the dented part and rotates the main body 10 to move the upper pressing rod 13 and the lower pressing rod 51 to positions or angles which are convenient for s/he to operate. Then, the user presses the lower pressing rod 51 to suck the dented part of the metal plate 80 upward to repair the dented part.

Given the above, the drawing device has a simple structure and is easy to be assembled, the pressing rods can rotate freely, and the user can rotate the pressing rods to appropriate positions according to different requirements so that s/he can operate and apply force to the drawing device easily even in a narrow space.

While we have shown and described various embodiments in accordance with the present invention, it should be clear to those skilled in the art that further embodiments may be made without departing from the scope of the present invention.

What is claimed is:

1. A drawing device, including:

a main body;

a seat body, disposed below the main body and rotatably connected to the main body, a bottom portion of the seat body having two legs which have a preset distance therebetween;

a central axle, vertically penetrating the main body and the seat body and movable along a vertical direction, the main body and the seat body being rotatable around the central axle with respect to each other, a bottom portion of the central axle having a drawing portion to be connected to an object to be drawn;

two supporting members, respectively swingably pivoted to the two legs of the seat body, the central axle being located between the two supporting members;

a driving structure, attached to the main body and connected to the central axle to optionally move the central axle upward.

2. The drawing device of claim 1, wherein the main body includes two shells, the two shells define a receiving space, the main body has an upper hole, a lower hole and a side opening, the upper hole, the lower hole and the side opening respectively communicate with the receiving space, the upper hole, the lower hole and the side opening are respectively defined by the two shells, the central axle penetrates the upper hole, the receiving space and the lower hole, and the main body is connected to the seat body via the lower hole.

3. The drawing device of claim 2, wherein the main body extends outward from above the side opening to form an upper pressing rod, the driving structure includes a lower pressing rod, one of two ends of the lower pressing rod is pivoted within the receiving space, the other of the two ends of the lower pressing rod protrudes beyond the main body from the side opening, the lower pressing rod further forms a through hole, the through hole extends vertically, the central axle is disposed through the through hole, the central axle has a radially-enlarged portion above the through hole of the lower pressing rod, and the lower pressing rod is capable of being pressed to swing toward the upper pressing rod so as to push the radially-enlarged portion to lift the central axle upward.

4. The drawing device of claim 3, wherein the bottom portion of the central axle has a connecting portion which has a greater outer diameter, the connecting portion is for being connected to the sucking disc, and a spring is further sleeved on the central axle and bounces between the bottom portion of the seat body and the connecting portion to make the central axle have a tendency to move downward.

5. The drawing device of claim 2, wherein a top portion of the seat body extends upward to form a neck portion, a top portion of the neck portion has an annular edge which protrudes outward, an outer diameter of the annular edge is greater than an inner diameter of the lower hole of the main body and is received within the receiving space, and the neck portion is rotatably disposed through the lower hole of the main body.

6. The drawing device of claim 5, wherein the bottom portion of the main body protrudes downward to form a plurality of first protrusions, the first protrusions are arranged around the lower hole, the top portion of the seat body protrudes upward to form a plurality of second protrusions, the second protrusions are arranged around the neck portion, and the first protrusions correspond to the second protrusions so that the main body and the seat body are releasably positionable with each other.

7. The drawing device of claim 6, wherein a number of the first protrusions is greater than a number of the second protrusions.

8. The drawing device of claim 1, wherein each of the two supporting members is plate-shaped and pivoted to a bottom end of the leg of the seat body, and the two supporting members are respectively swingable about two pivotal axles parallel to each other.

9. The drawing device of claim 8, wherein a side of each of the two supporting members facing the other of the two supporting members has a recessed curved portion.

* * * * *